US010428518B2

(12) United States Patent
Hansort

(10) Patent No.: US 10,428,518 B2
(45) Date of Patent: Oct. 1, 2019

(54) FLOOR DOWEL SLEEVE FOR CONCRETE SLAB SEAMS

(71) Applicant: Midwest Concrete & Masonry Supply, Inc., Naperville, IL (US)

(72) Inventor: Marinus Hansort, St. Pete Beach, FL (US)

(73) Assignee: Midwest Concrete & Masonry Supply, Inc., Naperville, IL (US)

( * ) Notice: Subject to any disclaimer, the term of this patent is extended or adjusted under 35 U.S.C. 154(b) by 0 days.

(21) Appl. No.: 16/403,703

(22) Filed: May 6, 2019

(65) Prior Publication Data

US 2019/0257074 A1 Aug. 22, 2019

Related U.S. Application Data

(63) Continuation of application No. 15/869,799, filed on Jan. 12, 2018, now Pat. No. 10,323,406.

(60) Provisional application No. 62/466,704, filed on Jan. 16, 2017.

(51) Int. Cl.

| | |
|---|---|
| ***E01C 11/14*** | (2006.01) |
| ***E04B 1/41*** | (2006.01) |
| ***E04B 1/48*** | (2006.01) |
| ***E04B 5/02*** | (2006.01) |
| ***E04B 5/32*** | (2006.01) |

(52) U.S. Cl.

CPC ..... *E04B 1/4114* (2013.01); *E04B 1/483* (2013.01); *E04B 5/023* (2013.01); *E04B 5/32* (2013.01); *E04B 2005/324* (2013.01); *E04B 2103/02* (2013.01)

(58) Field of Classification Search

CPC . E04B 1/483; E04B 1/48; E01C 11/14; E01C 19/504

See application file for complete search history.

(56) References Cited

U.S. PATENT DOCUMENTS

| | | | |
|---|---|---|---|
| 2,096,702 | A | 10/1937 | Yeoman |
| 2,194,718 | A | 3/1940 | Older |
| 2,305,979 | A | 12/1942 | Mitchell |
| 2,476,243 | A | 7/1949 | Heltzel |

(Continued)

FOREIGN PATENT DOCUMENTS

EP 1389648 B1 1/2007

OTHER PUBLICATIONS

PNA Construction Technologies, Inc., Diamond Dowel System, Jan. 2010.

(Continued)

*Primary Examiner* — Gisele D Ford

(74) *Attorney, Agent, or Firm* — Honigman LLP

(57) ABSTRACT

A floor dowel sleeve is provided that includes a rectangular-shaped body portion having a cavity that is configured to receive a dowel plate that spans across a seam between concrete slabs. A pair of break-away interior walls extend within the cavity from the opening to the end wall of the sleeve. The interior walls extend between two opposing (horizontal) walls of the exterior side walls and are continuously spaced from the other two opposing (vertical) walls of the exterior side walls. The body portion is configured to receive the dowel plate in the cavity between the break-away interior walls, where the break-away interior walls are configured to at least partially break-away from the exterior side walls upon lateral horizontal movement of the dowel plate within the cavity.

20 Claims, 6 Drawing Sheets

(56) References Cited

U.S. PATENT DOCUMENTS

| | | | |
|---|---|---|---|
| 3,559,541 | A | 2/1971 | Watstein |
| 5,005,331 | A | 4/1991 | Shaw et al. |
| 5,216,862 | A | 6/1993 | Shaw et al. |
| 5,344,251 | A | 9/1994 | Erb |
| 5,618,125 | A | 4/1997 | McPhee et al. |
| 5,674,028 | A | 10/1997 | Norin |
| 5,678,952 | A | 10/1997 | Shaw et al. |
| 5,713,174 | A | 2/1998 | Kramer |
| 5,797,231 | A | 8/1998 | Kramer |
| 5,934,821 | A | 8/1999 | Shaw et al. |
| 5,941,045 | A | 8/1999 | Plehanoff et al. |
| D419,700 | S | 1/2000 | Shaw et al. |
| 6,145,262 | A | 11/2000 | Schrader et al. |
| 6,354,760 | B1 | 3/2002 | Boxall et al. |
| D459,205 | S | 6/2002 | Shaw et al. |
| 6,502,359 | B1 | 1/2003 | Rambo |
| 6,692,184 | B1 | 2/2004 | Kelly et al. |
| 6,758,023 | B1 | 7/2004 | Sorkin |
| 6,926,463 | B2 | 8/2005 | Shaw et al. |
| 7,004,443 | B2 | 2/2006 | Bennett |
| 7,314,333 | B2 | 1/2008 | Shaw et al. |
| 7,338,230 | B2 | 3/2008 | Shaw et al. |
| 7,381,008 | B2 | 6/2008 | Shaw et al. |
| 7,441,985 | B2 | 10/2008 | Kelly et al. |
| 7,481,031 | B2 | 1/2009 | Boxall et al. |
| 7,604,432 | B2 | 10/2009 | Shaw et al. |
| 7,736,088 | B2 | 6/2010 | Boxall et al. |
| 7,748,928 | B2 | 7/2010 | Estes et al. |
| 7,967,527 | B2 | 6/2011 | Estes et al. |
| 8,465,222 | B1 | 6/2013 | Ghauch et al. |
| 8,672,579 | B2 | 3/2014 | Laiho et al. |
| 9,340,969 | B1 | 5/2016 | Shaw |
| 2005/0036835 | A1 | 2/2005 | Shaw et al. |
| 2005/0214074 | A1 | 9/2005 | Shaw et al. |
| 2006/0140721 | A1 | 6/2006 | Shaw et al. |
| 2006/0182496 | A1 | 8/2006 | Shaw et al. |
| 2006/0275078 | A1 | 12/2006 | Shaw et al. |
| 2007/0231068 | A1 | 10/2007 | Francies et al. |
| 2007/0269266 | A1 | 11/2007 | Kelly et al. |
| 2008/0014018 | A1 | 1/2008 | Boxall et al. |
| 2009/0035063 | A1 | 2/2009 | Estes et al. |
| 2010/0054858 | A1 | 3/2010 | Mayo et al. |
| 2010/0313518 | A1 | 12/2010 | Berg |
| 2015/0197898 | A1 | 7/2015 | Shaw |
| 2015/0204026 | A1 | 7/2015 | McDonald |
| 2016/0083914 | A1 | 3/2016 | Shaw |
| 2016/0222600 | A1 | 8/2016 | Shaw |

OTHER PUBLICATIONS

Greenstreak Group, Inc., You have a Choice!, Mar. 2010.

PNA Construction Technologies, Inc, $PD^3$ Basket Assembly, Jan. 2010.

PNA Construction Technologies, Inc., Square Dowel and Clip, Jan. 2010.

FLOOR DOWEL SLEEVE FOR CONCRETE SLAB SEAMS

CROSS-REFERENCE TO RELATED APPLICATION

The present application is a continuation of U.S. Non-Provisional application Ser. No. 15/869,799, filed Jan. 12, 2018, which claims the filing benefit of U.S. Provisional Application Ser. No. 62/446,704, filed Jan. 16, 2017, which are hereby incorporated herein by reference in their entirety.

FIELD OF THE INVENTION

The present invention generally relates to pockets or sleeves for concrete reinforcements and related seam reinforcement assemblies that extend between adjacent concrete slabs, and more particularly to dowel sleeves that are cast into edges of concrete slabs for receiving dowel plates or bars or the like.

BACKGROUND OF THE INVENTION

It is relatively common to reinforce the seams between concrete floor slabs to prevent the slabs from heaving relative to each other under unstable loading conditions and/or temperature fluctuations. When reinforcement member are cast to extend between these floor slabs, cracking and failure in the concrete may occur at the reinforcement member from horizontal movement between the slabs. Accordingly, to prevent this cracking, it is known to use pockets or sleeves with plates and bars that extend across joints between concrete slabs, where the pockets and sleeves allow the plates or bars to move in the pockets or sleeves.

SUMMARY OF THE PRESENT INVENTION

The present invention provides a floor dowel sleeve that receives a dowel plate that spans between and vertically supports concrete slabs at a seam between the concrete slabs, where the sleeve is configured to allow the dowel plate to move horizontally within the sleeve, such as from forces exerted by shifting or heaving of the concrete slabs. The floor dowel sleeve may have a rectangular-shaped cavity that is used to house a rectangular-shaped dowel that extends between two adjacent concrete floor slabs to maintain a level seam between the slabs. The dowel restricts vertical shear forces between the slabs; however, the sleeve allows horizontal movement (lateral and longitudinal) between the slabs, such as due to expansion or contraction of the concrete slabs. The sleeve is cast in one of the adjacent concrete slabs and the rectangular-shaped dowel is then inserted in the sleeve to allow an exposed end of the dowel to be cast into the other slab.

According to one aspect of the present invention, a floor dowel sleeve is provided for receiving a dowel plate that spans between and vertically supports concrete slabs at a seam between the concrete slabs. The floor dowel sleeve includes a rectangular-shaped body portion having four exterior side walls and an end wall that, together, surround a cavity. The cavity is configured to receive a dowel plate at an opening opposite the end wall of the body portion. A pair of break-away interior walls extend within the cavity from the opening to the end wall. The interior walls extend between two opposing (horizontal) walls of the exterior side walls and are continuously spaced from the other two opposing (vertical) walls of the exterior side walls. The body portion is configured to receive the dowel plate in the cavity between the break-away interior walls, where the break-away interior walls are configured to at least partially break-away from the exterior side walls upon lateral horizontal movement of the dowel plate within the cavity.

Optionally, the break-away interior walls may include weakened portions at or near at least one of upper and lower connection points with the horizontally-oriented opposing side walls, where the weakened portions are configured to break to allow the interior walls to break away from the body portion. Also, the body portion may be configured to space the dowel plate away from the end wall within the cavity, such as by providing crush members that protrude within the cavity from the end wall toward the opening of the cavity, where the crush members may be configured to collapse or compress toward the end wall upon longitudinal horizontal movement of the dowel plate. The crush members may protrude within the cavity from the end wall a distance generally less than a third of the distance between the opening and the end wall. Further, all or portions of the sleeve may be integrally formed as a single piece, such as a single, injection molded plastic piece.

According to another aspect of the present invention, a floor dowel sleeve assembly is provided that spans between and vertically supports concrete slabs at a seam between the concrete slabs. The floor dowel sleeve assembly includes a rectangular-shaped dowel plate having a first portion that is configure to be cast into a first concrete slab. A rectangular-shaped sleeve is also provided that has four exterior side walls and an end wall that together surround a cavity that has an end opposing the end wall, where the sleeve is configured to be cast into a second concrete slab adjacent to and forming a seam with the first concrete slab. A pair of break-away interior walls extend within the cavity at a spaced distance from lateral walls of the exterior side walls, where the interior walls integrally extend between opposing upper and lower walls of the exterior side walls. Crush members integrally protrude from the end wall within the cavity toward the opening. The second portion of the dowel plate is movably inserted in the cavity between the break-away interior walls and in abutting contact with the opposing upper and lower walls and a distal portion of the crush members, where the break-away interior walls are configured to break-away from the opposing upper and lower walls upon lateral horizontal movement of the dowel plate. The crush member are configured to compress toward the end wall upon longitudinal horizontal movement of the dowel plate.

These and other objects, advantages, purposes, and features of the present invention will become apparent upon review of the following specification in conjunction with the drawings.

DETAILED DESCRIPTION OF EMBODIMENTS

Figure 1:
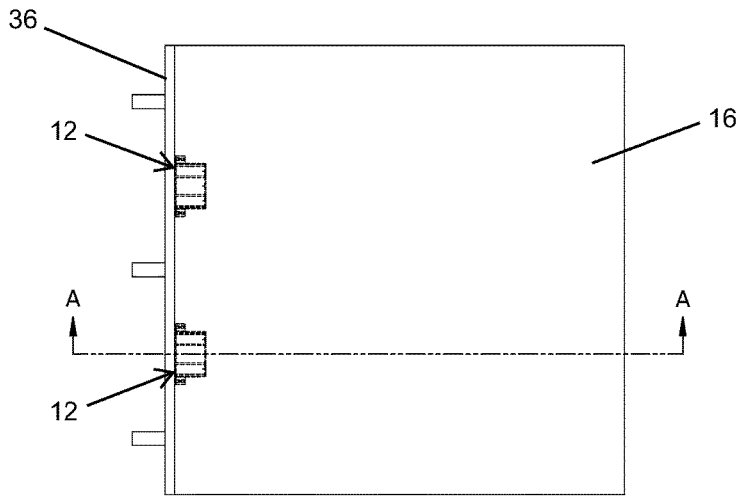
FIG. 1 is a top plan view of a concrete form having two floor dowel sleeves attached at an interior of the form and cast within the formed concrete slab, in accordance with the present invention.
Figure 1A:
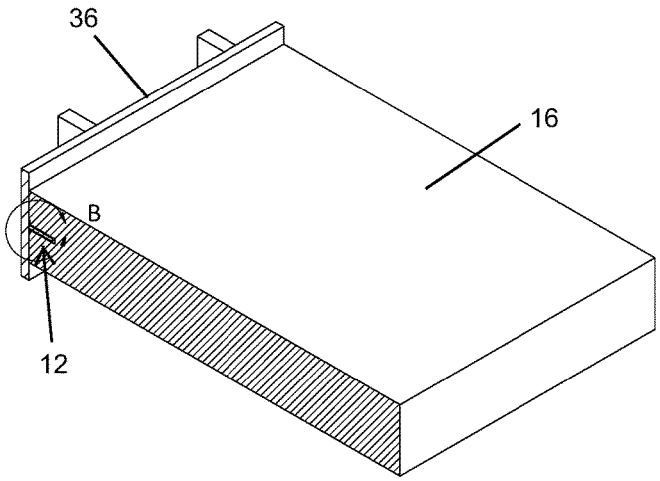
FIG. 1A is a cross-sectional upper perspective view of the concrete form and slab taken at section A-A in FIG. 1, showing the floor dowel sleeve cast within the concrete slab.

Referring now to the drawings and the illustrative embodiments depicted therein, a floor dowel sleeve assembly 10 (FIG. 3) is provided that includes a floor dowel sleeve 12 that receives a dowel plate 14 that spans between and vertically supports adjacent concrete slabs 16 at a seam between the adjacent concrete slabs to maintain a flush seam or desired level between the slabs. The dowel plate 14 has a substantially rectangular shape and a first rectangular portion that is cast into one of the concrete slabs, while a second rectangular portion of the dowel plate 14 is received in a rectangular-shaped cavity 18 of the floor dowel sleeve 12. Typically, prior to casting the first portion of the dowel plate 14 in concrete or inserting the dowel plate 14 in the sleeve 12, the floor dowel sleeve 12 is first cast in a concrete slab 16. The dowel plate 14 is then inserted in the sleeve 12 to allow an exposed end of the dowel to be cast into the other slab. The cast dowel then acts to restrict vertical shear forces between the slabs, while allowing horizontal movement in the sleeve cavity 18, such as due to expansion or contraction of the concrete slabs.

The floor dowel sleeve 12 includes a rectangular-shaped body portion 20 having four exterior side walls 22, 24, 26, 28 and an end wall 30 that, together, surround the cavity 18. The dowel sleeve 12 receives the dowel plate 14 at an opening 18*a* to the cavity 18 opposite the end wall 30 of the body portion 20. A pair of break-away interior walls 32 extend within the cavity 18 from the opening 18*a* to the end wall 30. The interior walls 32 extend vertically between two opposing (horizontal) exterior walls 22, 24 and are continuously spaced from the other two opposing (vertical) exterior walls 26, 28, so as to enclose outer areas 18*a*, 18*b* of the cavity between the interior walls 32 and the exterior walls 22, 24. The dowel plate 14 is received between the break-away interior walls 32, such that the break-away interior walls 32 are configured to at least partially break away from the exterior side walls 22, 24 upon lateral horizontal movement of the dowel plate within the cavity. Upon the interior walls 32 breaking away from the upper and lower side walls 22, 24, the dowel plate is permitted to move laterally into the out areas 18*a*, 18*b* of the cavity 18.

Figure 6:
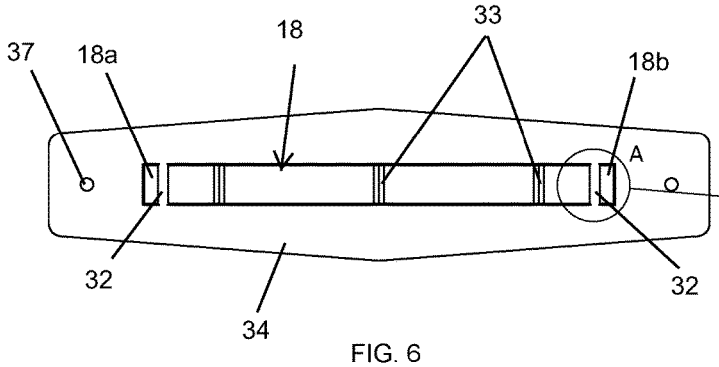
FIG. 6 is an end elevational view of the floor dowel sleeve illustrated in FIG. 4, having the dowel plate removed to show to the cavity.
Figure 6A:
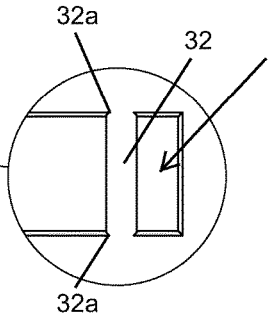
FIG. 6A is an enlarged view of an interior wall extending within the cavity of the floor dowel sleeve, taken at section A of FIG. 6.

The break-away interior walls 32 may include weakened portions 32*a* (FIG. 6A) at or near at least one of upper and lower connection points with the horizontally-oriented opposing side walls 22, 24. Such weakened portions are configured to break to allow the interior walls to break away from the body portion. For example, the weakened portions may comprise a narrowed area, a perforation, a loosely attached seam, or the like. As shown in FIGS. 6-6A, the cavity of the sleeve includes two break-away walls that extend integrally within the sleeve, and that are continuously spaced from the interior vertical side walls. The break-away walls 32 may be positioned to center the dowel in the sleeve and approximately equally space the dowel plate away from the exterior vertical side walls 22, 24 of the sleeve.

Figure 7:
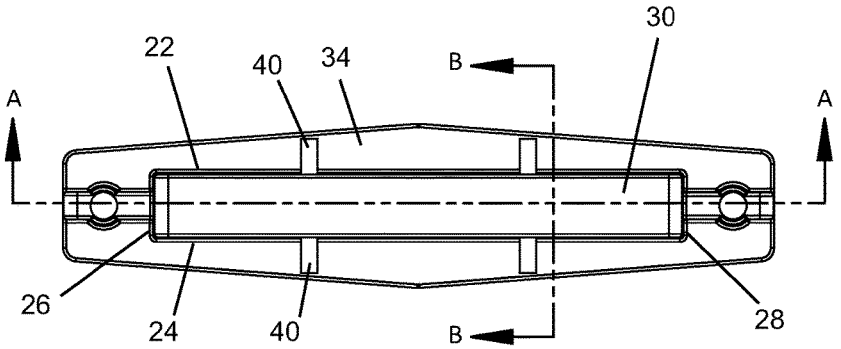
FIG. 7 is an end elevational view of the floor dowel sleeve shown in FIG. 4.
Figure 7A:
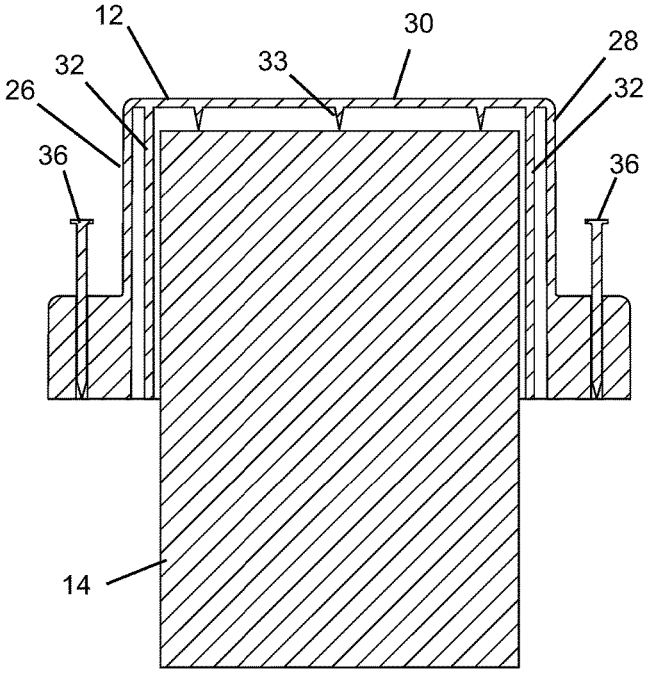
FIG. 7A is a cross-sectional view of the floor dowel sleeve and dowel plate inserted within the cavity of the sleeve, taken at line A-A of FIG. 7.
Figure 7B:
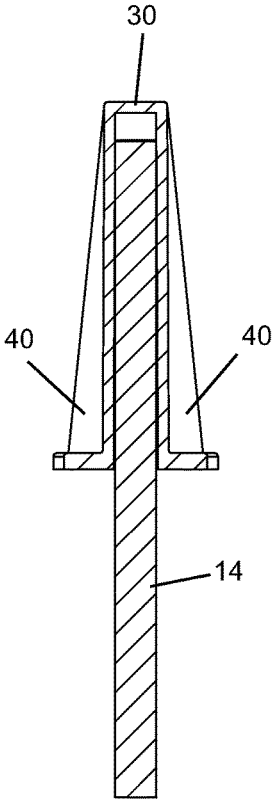
FIG. 7B is a cross-sectional view of the floor dowel sleeve and dowel plate inserted within the cavity of the sleeve, taken at line B-B of FIG. 7.
Figure 8:
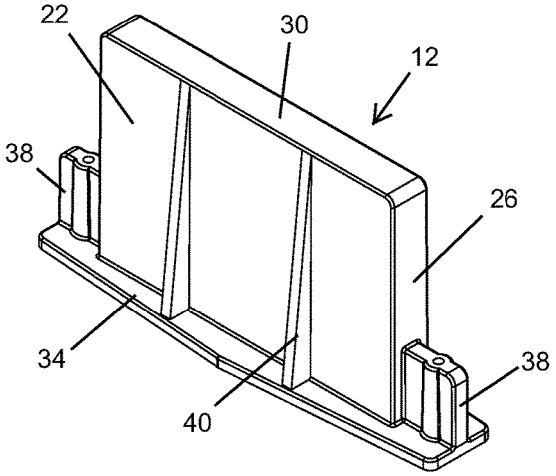
FIG. 8 is a perspective view of the floor dowel sleeve illustrated in FIG. 4, shown without the dowel plate in the sleeve.
Figure 9:
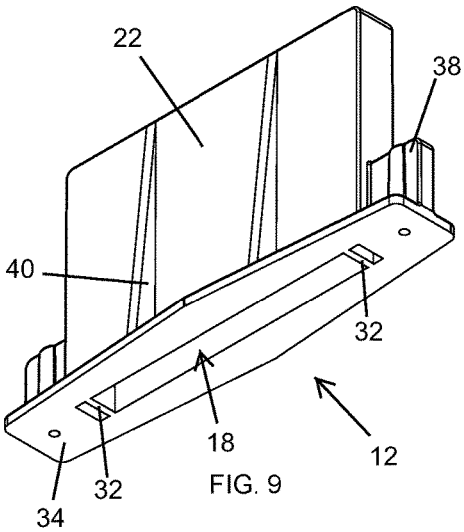
FIG. 9 is another perspective view of the floor dowel sleeve, taken from an opposing end of the sleeve from that illustrated in FIG. 8.
Figure 10:
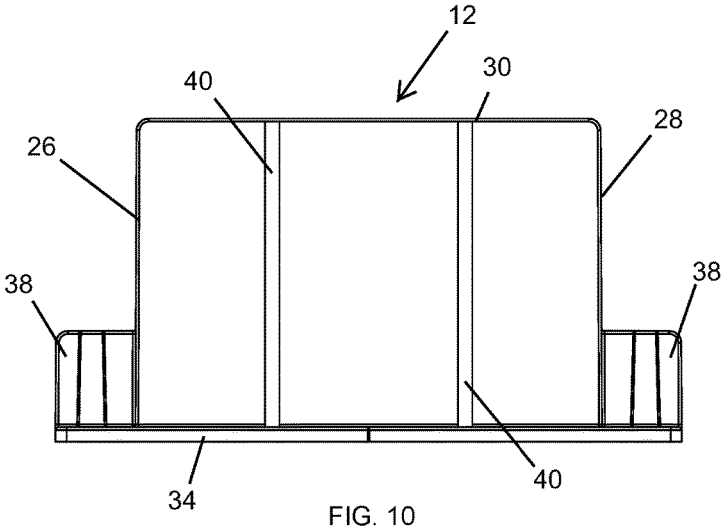
FIG. 10 is a side elevational view of the floor dowel sleeve illustrated in FIG. 8.
Figure 11:
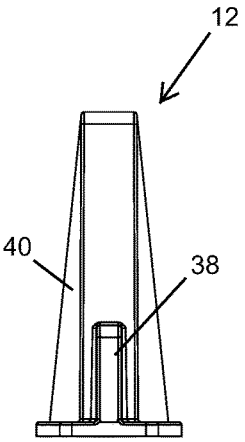
FIG. 11 is another side elevational view of the floor dowel sleeve illustrated in FIG. 8.
Figure 12:
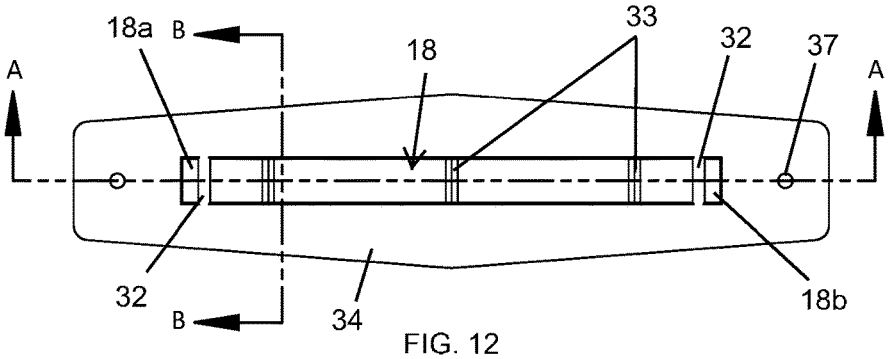
FIG. 12 is an end elevational view of the floor dowel sleeve illustrated in FIG. 8.
Figure 12A:
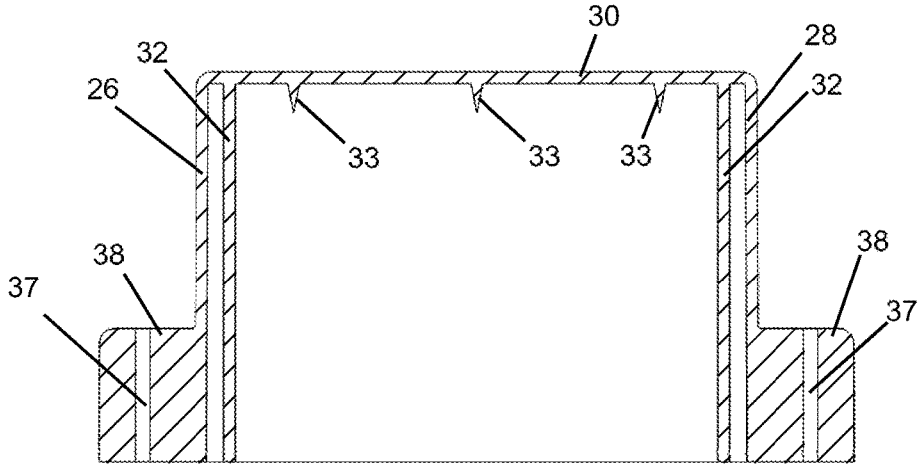
FIG. 12A is a cross-sectional view taken at line A-A of FIG. 12.
Figure 12B:
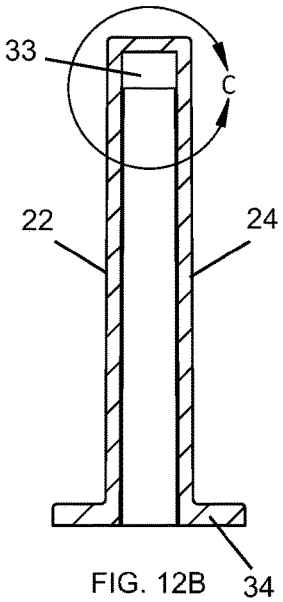
FIG. 12B is a cross-sectional view taken at line B-B of FIG. 12.
Figure 12C:
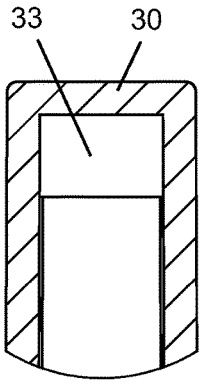
FIG. 12C is an enlarged view of a crush member extending from an end wall of the floor dowel sleeve, taken at section C of FIG. 12B.
Figure 13:
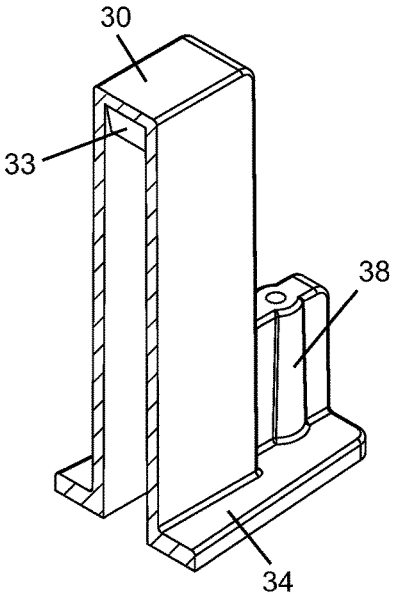
FIG. 13 is a cross-sectional perspective view of the floor dowel sleeve taken at line B-B of FIG. 12.

Also, the floor dowel sleeve 12 may be configured to space the dowel plate 14 away from the end wall 30 within the cavity, such as by providing a plurality of crush members 33 that protrude within the cavity 18 from the end wall 30 toward the opening 18*a* of the cavity. The plurality of crush members 33 may comprise crush ribs or spikes or the like that are each configured to collapse or compress toward the end wall 30 upon longitudinal horizontal movement of the dowel plate 14. As shown in FIG. 7A, the crush members or spikes have a v-shape and narrow to a point as they extend away from the end wall 30, such that they are configured to compress or crush toward the end wall 30 from horizontal forces exerted by the dowel plate 14 to allow for such movement of the dowel 14 within the sleeve 12 and corresponding movement between the slabs 16 on opposing sides of the seam. The plurality of crush members 33 may preferably protrude within the cavity 18 from the end wall 30 a distance generally less than a third of the distance between the opening 18*a* and the end wall 30, so the dowel plate does not become overly offset into one of the adjacent concrete slabs.

Figure 1B:
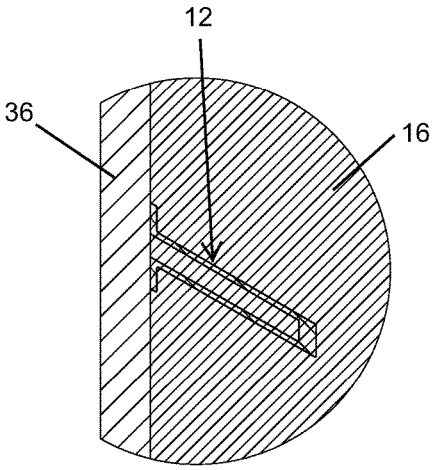
FIG. 1B is an enlarged view of the cross section of the floor dowel sleeve cast in the concrete slab, taken at section B of FIG. 1A.
Figure 2:
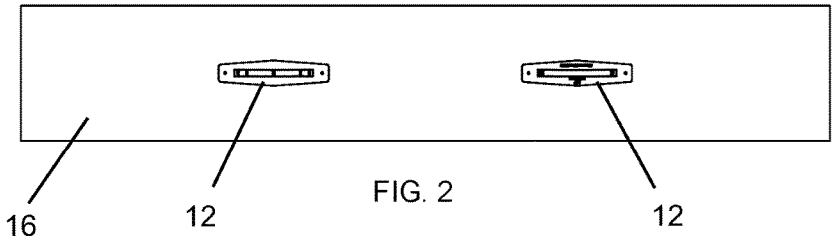
FIG. 2 is an end elevational view of the concrete slab and cast floor dowel sleeves illustrated in FIG. 1, after the concrete form is removed.

As shown, for example, in FIGS. 1-1B, the floor dowel sleeve 12 has a collar portion 34 that is temporarily attached to a wall 36 of a concrete form that at least partially surrounds the concrete floor slab 16 being cast. When attached at the illustrated concrete form, the dowel sleeve 12 is horizontally suspended to extend into the area surrounding the concrete form, such that once the concrete is poured, the sleeve 12 is disposed at an edge portion of the concrete slab. The illustrated collar portion 34 is integrally connected with the exterior side walls 22, 24, 26, 28 of the body portion 20 and extends continuously around the opening 18*a* of the cavity 18, such as shown in FIG. 6. Accordingly, when attached to the concrete form, the collar portion 34 is placed in substantially continuous contact with concrete form around the opening, such that concrete is permitted from entering the cavity 18. Optionally, when casting the sleeve 12 in the concrete slab, a piece of tape or similar film covering may be provided over the opening 18*a* of the cavity 18 to further prevent concrete from entering the cavity during the casting process. A logo and/or other indicia may also be provided on the collar 34 that surrounds the opening 18*a* to the cavity 18, so as to be visible after being cast, such as shown in FIGS. 2-3A.

Figure 4:
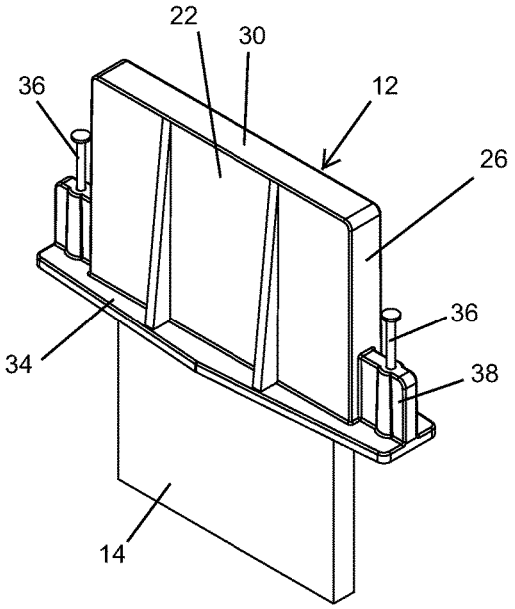
FIG. 4 is a perspective view of a floor dowel sleeve having a dowel plate inserted into a cavity of the sleeve.
Figure 5:
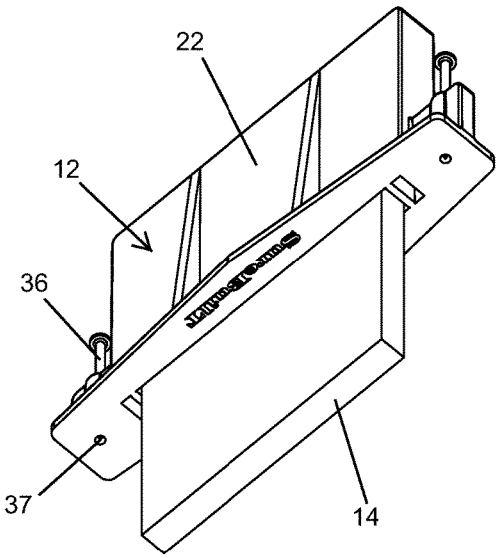
FIG. 5 is another perspective view of the floor dowel sleeve and dowel plate inserted into the sleeve, taken from an opposing end of the sleeve from that illustrated in FIG. 4.

The collar portion 34 may be attached to the concrete form with a fastener, such as the illustrated nails 36 or similar mechanical fasteners that extend through a hole 37 in an embossment 38 formed on the collar portion 23 (FIG. 4). The fastener embossment 38 may be formed to integrally interconnect with the exterior of the body portion 20 and to provide stiffening and support between the collar portion 34 and the body portion 20. The exterior surface of the sleeve 12 may also include stiffening flanges 40 that extend along the outer surface of the body portion 20 of the sleeve 12, from the collar portion 34 to the end wall 30 of the sleeve opposite the opening. The stiffening flanges 40 (FIG. 7) may extend perpendicular to the collar portion 34 and gradually taper in height, narrowing as they extend away from the collar portion 34. Also, additional reinforcements may be provide for stabilizing the sleeve in the concrete and preventing the cavity from collapsing, such as during the casting process.

Further, all or portions of the sleeve 12 may be integrally formed as a single piece, such as a single piece comprising at least one of a polymer, fiber composite, and metal material. As illustrated, the sleeve, including the breakaway walls, crush members or spikes, stiffening flanges, and the side reinforcements, are integrally formed from a single piece of rigid polymer, such as a single, injection molded plastic piece.

Figure 3:
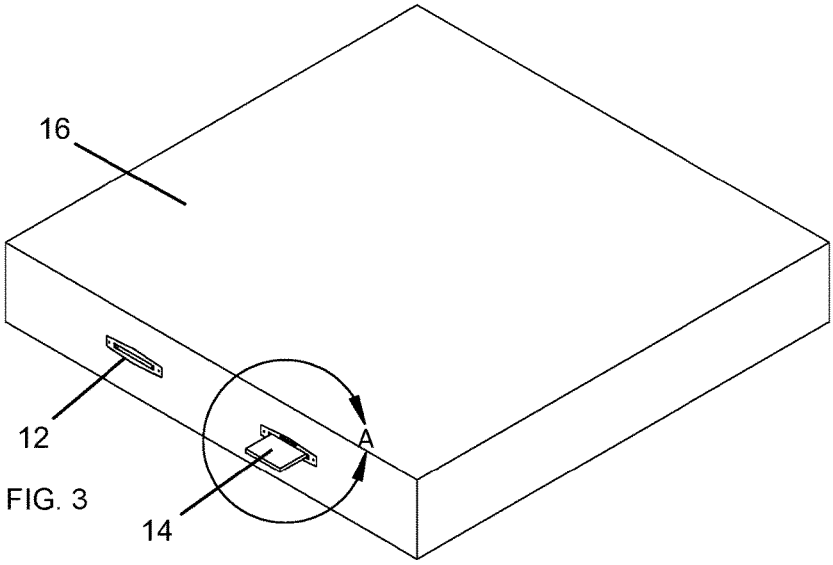
FIG. 3 is an upper perspective view of the concrete slab and cast floor dowel sleeves illustrated in FIG. 2, showing a dowel plate inserted into one of the floor dowel sleeves.
Figure 3A:
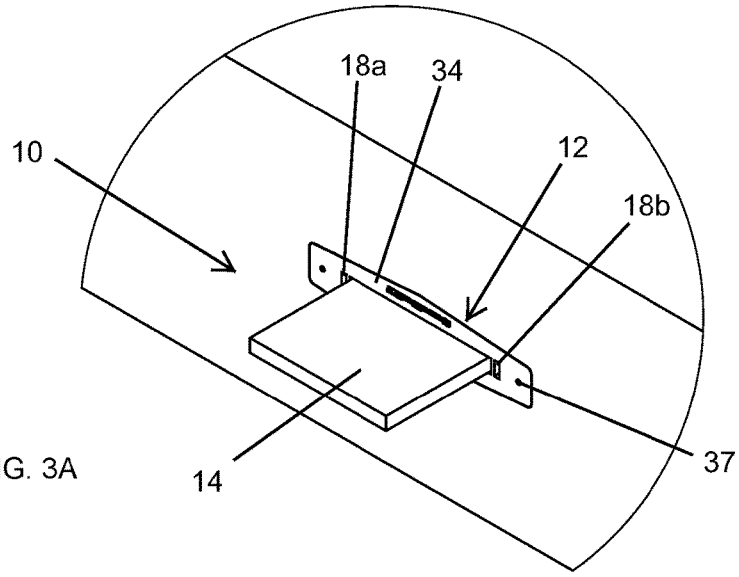
FIG. 3A is an enlarged view of the dowel plate inserted into the floor dowel sleeve, taken at section A of FIG. 3.

For purposes of this disclosure, the terms "upper," "lower," "right," "left," "rear," "front," "vertical," "horizontal," and derivatives thereof shall relate to the invention as oriented in FIG. 3. However, it is to be understood that the invention may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A floor dowel sleeve for receiving a dowel plate that spans between and vertically supports concrete slabs at a seam between the concrete slabs, said floor dowel sleeve comprising:

a sleeve body portion having an upper wall, a lower wall, and a side wall that continuously connects between the upper and lower walls to form a cavity that is configured to receive a dowel plate at a front opening, wherein the upper and lower walls are configured to contact respective top and bottom surfaces of the dowel plate in the cavity;

a break-away interior wall disposed within the cavity and extending continuously between the upper and lower walls to define a transverse barrier surface that is generally perpendicular to the upper and lower walls and that forms a continuous void between an edge of the dowel plate and the side wall, wherein the break-away interior wall is configured to at least partially break-away from at least one of the upper or lower walls upon lateral movement of the dowel plate into the continuous void;

a collar portion have a planar shape disposed around the front opening and integrally connected to the upper wall, the lower wall, and the side wall; and a stiffening flange that extends from the collar portion along an outer surface of the sleeve body portion to prevent the sleeve body portion from collapsing into the cavity.

2. The floor dowel sleeve of claim 1, wherein the stiffening flange is integrally connected to the upper wall of the sleeve body portion.

3. The floor dowel sleeve of claim 2, wherein the stiffening flange has a height extending upward from the upper wall, and wherein the height of the stiffening flange tapers as the stiffening flange extends away from the collar portion.

4. The floor dowel sleeve of claim 1, wherein the collar portion extends in a perpendicular orientation relative to the upper wall and the lower wall, and wherein the stiffening flange extends from the collar portion in a plane that is generally perpendicular to a planar extent of the collar portion.

5. The floor dowel sleeve of claim 1, further comprising a plurality of crush members disposed within the cavity and protruding from a rear section of the sleeve body portion toward the front opening, wherein the plurality of crush member are configured to collapse toward the rear section upon rearward longitudinal movement of the dowel plate.

6. The floor dowel sleeve of claim 1, wherein the break-away interior wall includes a weakened portion at or near at least one of upper or lower walls of the sleeve body portion, and wherein the weakened portion is configured to break to allow the break-away interior wall to break away from the corresponding upper or lower wall.

7. The floor dowel sleeve of claim 1, wherein the sleeve body portion, the break-away interior wall, the collar portion, and the stiffening flange are integrally formed as a single piece comprising a polymer.

8. The floor dowel sleeve of claim 1, wherein the upper wall and the lower wall are substantially parallel with each other and substantially perpendicular with the side wall of the sleeve body portion.

9. A floor dowel sleeve for receiving a dowel plate that spans between and vertically supports concrete slabs at a seam between the concrete slabs, said floor dowel sleeve comprising:

a sleeve body portion having an upper wall disposed in an upper longitudinal plane, a lower wall disposed in a lower longitudinal plane that is parallel with the upper longitudinal plane, and a side wall extending continuously between the upper and lower walls that forms a cavity with a front opening configured to receive a dowel plate that is inserted into the cavity;

a collar portion disposed around the front opening of the cavity in a transverse plane that is perpendicular the upper and lower longitudinal planes, wherein the collar portion is integrally connected to the upper wall, the lower wall, and the side wall of the sleeve body portion;

a stiffening flange extending rearward from the collar portion along an outer surface of the upper wall or lower wall, wherein the stiffening flange is integrally connected along the respective upper or lower wall to prevent it from collapsing into the cavity;

a break-away interior wall that extends longitudinally within the cavity from the front opening toward a rear portion of the cavity, wherein the break-away interior wall is integrally connected to and extending between the upper and lower walls of the sleeve body portion, and wherein the break-away interior wall is continuously spaced from an interior surface of the side wall to provide a void therebetween; and wherein the cavity is configured to receive the dowel plate in abutting contact with the upper and lower walls and the break-away interior wall, and wherein the break-away interior wall is configured to at least partially break-away from at least one of the upper and lower walls upon lateral horizontal movement of the dowel plate in the cavity.

10. The floor dowel sleeve of claim 9, wherein the break-away interior wall includes a weakened portion at or near at least one of the upper or lower walls, and wherein the weakened portion is configured to break to allow the corresponding break-away interior wall to break away from the corresponding upper or lower wall.

11. The floor dowel sleeve of claim 9, wherein the stiffening flange is integrally connected to and extends along the upper wall of the sleeve body portion for preventing the upper wall from collapsing into the cavity.

12. The floor dowel sleeve of claim 11, wherein the stiffening flange has a height extending upward from the upper wall, and wherein the height of the stiffening flange tapers as the stiffening flange extends away from the collar portion toward the rear portion of the cavity.

13. The floor dowel sleeve of claim 9, wherein the stiffening flange extends from the collar portion generally in a plane that is generally perpendicular to the collar portion and the upper wall of the sleeve body portion.

14. The floor dowel sleeve of claim 9, further comprising a plurality of crush members disposed within the cavity and extending forward toward the front opening from the rear portion of the cavity a distance generally less than a third of a longitudinal depth of the cavity.

15. The floor dowel sleeve of claim 14, wherein at least one of the plurality of crush members is configured to collapse upon rearward longitudinal horizontal movement of the dowel plate within the cavity.

16. The floor dowel sleeve of claim 9, wherein the break-away interior wall, the collar portion, and the stiffening flange are integrally formed with the sleeve body portion as a single piece comprising a polymer.

17. A floor dowel sleeve for receiving a dowel plate that spans between and vertically supports concrete slabs at a seam between the concrete slabs, said floor dowel sleeve comprising:

a sleeve body having a cavity that is configured to receive a dowel plate at a front opening of the cavity;

a collar portion integrally connected with the sleeve body and disposed around the front opening of the cavity;

a stiffening flange integrally extending rearward from the collar portion along an outer surface of the sleeve body to stiffen and prevent the sleeve body from collapsing into the cavity when casting the floor dowel sleeve in a concrete slab;

a pair of break-away interior walls that are each disposed within the cavity and integrally extend between upper and lower walls of the sleeve body, wherein the pair of break-away interior walls extend longitudinally and continuously within the cavity from the front opening to a rear section of the sleeve body, and wherein the pair of break-away interior walls are disposed at a spaced distance from lateral side surfaces of the sleeve body to define a pair of continuous voids along edges of the sleeve body;

wherein the upper and lower walls are configured to contact respective top and bottom surfaces of the dowel plate and the pair of break-away interior walls are configured to contact opposing edges of the dowel plate; and wherein at least one of the pair of break-away interior walls is configured to break-away from at least one of the upper wall or lower wall upon lateral movement of the dowel plate within the cavity.

18. The floor dowel sleeve of claim 17, wherein the sleeve body bounds the cavity with an upper wall disposed in an upper longitudinal plane, a lower wall disposed in a lower longitudinal plane that is parallel with the upper longitudinal plane, and a side wall that continuously connects between the upper and lower walls, and wherein the collar portion has a planar shape that extends in a perpendicular orientation relative to the upper and lower walls.

19. The floor dowel sleeve of claim 18, wherein the stiffening flange is integrally connected to the upper wall of the sleeve body, wherein the stiffening flange has a height extending upward from the upper wall, and wherein the height of the stiffening flange tapers as the stiffening flange extends away from the collar portion.

20. The floor dowel sleeve of claim 18, wherein the pair of break-away interior walls include a weakened portion at or near at least one of the upper or lower walls.

* * * * *